US007891193B2

(12) United States Patent
Hernandez et al.

(10) Patent No.: US 7,891,193 B2
(45) Date of Patent: Feb. 22, 2011

(54) COOLING OF A MULTIMODE FUEL INJECTOR FOR COMBUSTION CHAMBERS, IN PARTICULAR OF A JET ENGINE

(75) Inventors: Didier Hippolyte Hernandez, Quiers (FR); Thomas Olivier Marie Noel, Vincennes (FR)

(73) Assignee: SNECMA, Paris (FR)

( * ) Notice: Subject to any disclaimer, the term of this patent is extended or adjusted under 35 U.S.C. 154(b) by 1084 days.

(21) Appl. No.: 11/620,269

(22) Filed: Jan. 5, 2007

(65) Prior Publication Data

US 2007/0157616 A1 Jul. 12, 2007

(30) Foreign Application Priority Data

Jan. 9, 2006 (FR) ..... 06 50069

(51) Int. Cl.
*F02C 7/22* (2006.01)
*F23R 3/28* (2006.01)

(52) U.S. Cl. ..... 60/742; 60/748; 239/132.5

(58) Field of Classification Search ..... 60/742, 60/748; 239/132.3, 132.5
See application file for complete search history.

(56) References Cited

U.S. PATENT DOCUMENTS

| | | | | | |
|---|---|---|---|---|---|
| 2,172,383 | A * | 9/1939 | Honn | 239/132.1 |
| 3,498,059 | A * | 3/1970 | Harvey et al. | 60/742 |
| 3,684,186 | A * | 8/1972 | Helmrich | 60/742 |
| 4,111,369 | A | 9/1978 | Sharpe | |
| 4,139,157 | A * | 2/1979 | Simmons | 239/400 |
| 4,798,330 | A | 1/1989 | Mancini et al. | |
| 4,865,542 | A * | 9/1989 | Hasenack et al. | 239/132.3 |
| 5,577,386 | A | 11/1996 | Alary et al. | |
| 6,321,541 | B1 * | 11/2001 | Wrubel et al. | 60/740 |
| 6,345,505 | B1 * | 2/2002 | Green | 60/742 |

OTHER PUBLICATIONS

U.S. Appl. No. 11/535,667, filed Sep. 27, 2006, Hernandez et al.
U.S. Appl. No. 11/620,314, filed Jan. 5, 2007, Hernandez et al.

* cited by examiner

*Primary Examiner*—Ted Kim
(74) *Attorney, Agent, or Firm*—Oblon, Spivak, McClelland, Maier & Neustadt, L.L.P.

(57) ABSTRACT

In a multimode fuel injector for combustion chambers, in particular a jet engine, a secondary circuit is connected to a distribution chamber perforated by a plurality of fuel ejection orifices and the primary circuit comprises at least one passage section adjacent the distribution chamber, for its cooling.

11 Claims, 3 Drawing Sheets

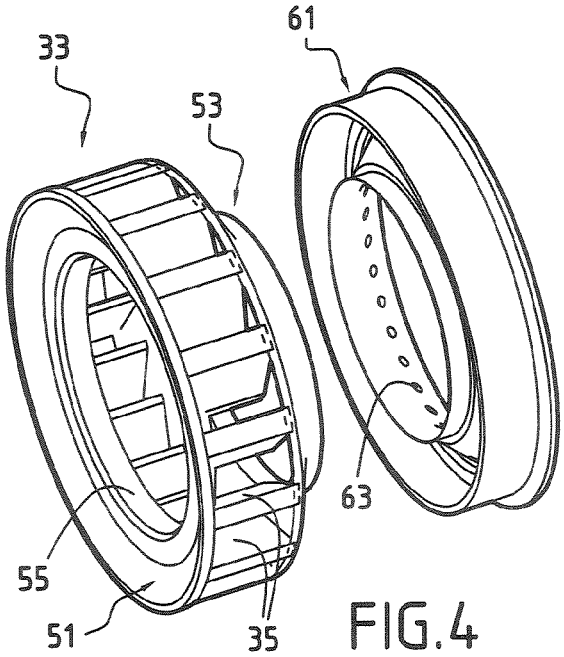
FIG.4
FIG.5
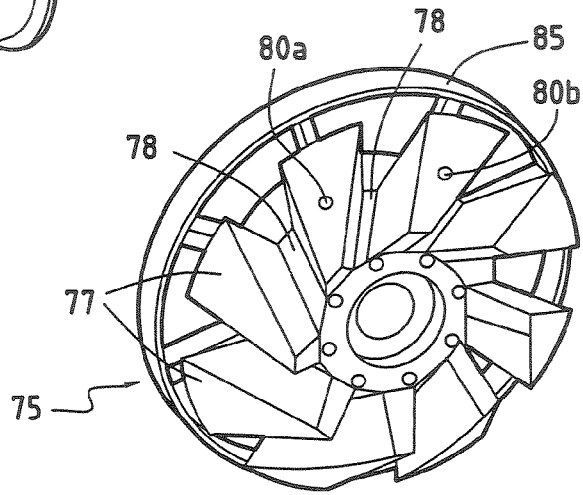
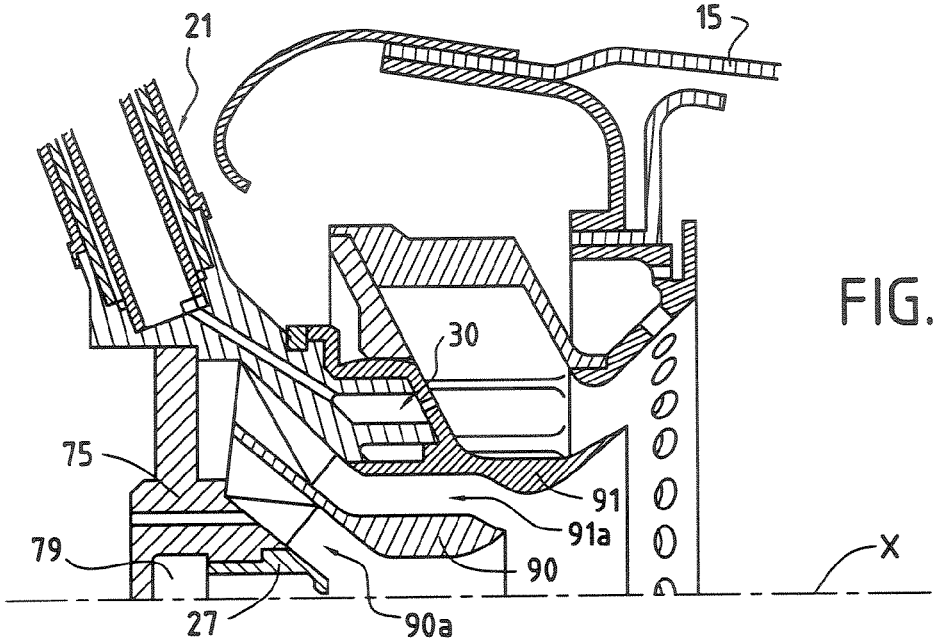
FIG.7

COOLING OF A MULTIMODE FUEL INJECTOR FOR COMBUSTION CHAMBERS, IN PARTICULAR OF A JET ENGINE

BACKGROUND OF THE INVENTION

1. Field of the Invention

The invention relates to a multimode fuel injector for combustion chambers, in particular the combustion chamber of a jet engine. More particularly it concerns the cooling of the annular distribution chamber fed by the secondary circuit and which communicates with a plurality of fuel ejection orifices ensuring the peripheral atomisation of the fuel delivered by the secondary circuit.

2. Discussion of the Background

In an aircraft jet engine, the combustion chamber is equipped with a plurality of fuel injectors distributed at regular intervals along the circumference at the back of the latter. Each fuel injector comprises an arm in which are defined coaxial passages belonging to a fuel circuit, called primary and a fuel circuit called secondary respectively. Each coaxial passage, defined inside the arm, feeds two coaxial fuel atomisation systems, defined in the same atomisation head.

The primary circuit or low engine speed circuit is designed to obtain particularly fine fuel atomisation. Its flowrate is limited but permanent.

The secondary circuit or high engine speed circuit is designed to supplement the fuel flowrate up to the point of full throttle making it possible, in particular, to attain all the power necessary for takeoff. On the other hand, this secondary circuit is not used permanently and its flowrate is sometimes very weak at certain engine speeds.

As an example, EP 1 369 644 describes a multimode fuel injector of this type.

The compressed air coming from a high pressure compressor circulates in the casing where the combustion chamber is located. Part of the air crosses the fuel injectors, mixes with the fuel delivered by the primary and secondary circuits at the back of the combustion chamber, before igniting in the latter.

The fuel injector can be subjected to high temperatures (300° K to 950° K for power at full throttle) since it is installed in a flow of hot air coming from the last stage of the high pressure compressor. Moreover, during certain phases of operation where the temperature of the air from the compressor is relatively high (430° to 630° K), the secondary circuit may not be used or may have a very weak flowrate.

Gumming or coking could result from the fuel stagnating inside the atomisation head and more particularly inside the annular distribution chamber feeding the various fuel ejection orifices providing peripheral atomisation. These phenomena can impair the quality of atomisation of the fuel supplied by the secondary circuit and cause non-homogeneous carburetion in the combustion chamber as well as a distortion of the map of the temperatures inside the latter. This can result in a loss of performance of the combustion chamber and the high pressure turbine. These problems may cause burning of the high pressure distributor, high pressure turbine and even certain components of the low pressure turbine.

SUMMARY OF THE INVENTION

The invention proposes a new design for the atomisation head making it possible to eliminate the risk of coking by ensuring cooling of the fuel delivered by the secondary circuit, through permanent circulation of the fuel delivered by the primary circuit.

More particularly, the invention relates to a multimode fuel injector for combustion chambers, of the type having two coaxial fuel atomisation systems, fed respectively by two circuits, a primary circuit with permanent flowrate and a secondary circuit with intermittent flowrate, characterized in that it comprises an atomisation head in which said secondary circuit is connected to an annular distribution chamber perforated with a plurality of fuel ejection orifices distributed at regular intervals along the circumference and in which said primary circuit comprises at least one passage section adjacent said distribution chamber, for its cooling.

For example, said passage section comprises an external annular section radially arranged on the outside relative to said distribution chamber and an internal annular section radially arranged on the inside relative to this same distribution chamber.

The two annular sections can be connected in series.

According to an alternative, the distribution chamber comprises two separately fed symmetrical parts, while the two internal and external annular sections each comprise branches adjacent said two symmetrical parts respectively.

The atomisation head is constituted by the assembly of several parts. Among these parts, an annular body connected to the arm comprises grooves engraved on its downstream face and defining the distribution chamber and said passage section of said primary circuit responsible for cooling it. An annular flange covers these grooves, said fuel ejection orifices being provided in this flange. Advantageously, said grooves are obtained by electro-erosion carried out in a single operation on a rough casting of this annular body.

BRIEF DESCRIPTION OF THE DRAWINGS

The invention will be better understood and its other advantages will appear clearer in the light of the description, which will follow, given purely as an example and intended to be read with reference to the appended drawings, in which:

FIG. 4 is an exploded view in perspective of part of the fuel injector;

FIG. 5 is a view in perspective of another part of the fuel injector;

FIG. 7 is a partial half-sectional view similar to FIG. 1, illustrating another alternative.

DETAILED DESCRIPTION OF THE PREFERRED EMBODIMENTS

Figure 1:
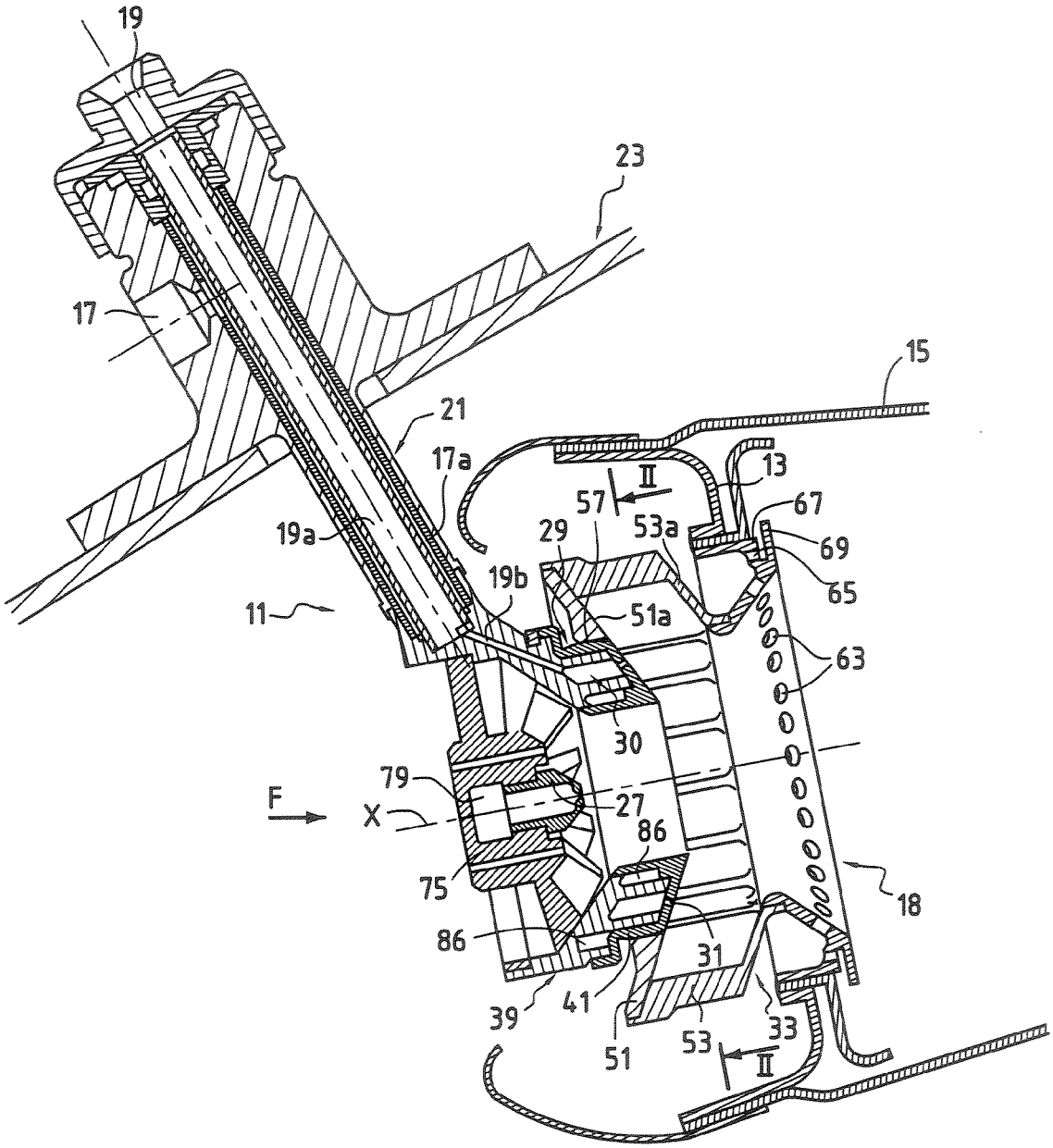
FIG. 1 is a view in elevation and in section of a fuel injector according to the invention.

In FIG. 1, one of the multimode fuel injectors 11 mounted on the back wall 13 of an annular combustion chamber 15 of a turbo engine is schematically illustrated in section. In the example, two modes of injection are combined and the fuel injector described comprises two coaxial fuel atomisation systems, fed respectively by two fuel distribution circuits, a primary circuit 17, here with permanent flowrate and a secondary circuit 19, here with intermittent flowrate.

The two circuits have in common an arm 21 in which are arranged two coaxial passages 17*a*, 19*a*, belonging respectively to the primary and secondary circuits, connected to an atomisation head 18. The primary circuit with permanent flowrate has a relatively weak flowrate. It is more particularly adapted to low engine speed.

The secondary circuit 19 with intermittent flowrate is designed to supplement the fuel flowrate up to the point of full throttle, in particular making it possible to attain all the power necessary for takeoff. Its primarily variable flowrate may be zero or very weak at certain engine speeds.

The compressed air coming from a high pressure compressor (not illustrated) circulates in a casing 23 surrounding the combustion chamber 15. The air circulates from upstream towards the downstream, according to the direction of arrow F.

In the rest of the description, the terms "upstream" or "downstream" are used to indicate the position of one element relative to another, in consideration of the flow direction of the gases.

Part of the air penetrates into the combustion chamber 15 passing through the fuel injectors 11. The fuel is mixed with air at the back of the chamber before igniting in said combustion chamber.

In the atomisation head 18, the primary circuit 17 ends in an axial fuel ejection nozzle 27 (here axis X of the atomisation head itself is taken into account) while the secondary circuit is connected to a distributor 29 comprising an annular distribution chamber 30, communicating with a plurality of fuel ejection orifices 31, distributed at regular intervals along the circumference at the downstream end of the distributor.

The atomisation head comprises an annular body 39 attached to the arm 21, in which are provided borings belonging to said primary and secondary circuits and connecting the passages 17*a* 19*a* to nozzle 27 and the distribution chamber 30, respectively. In FIG. 1, a boring 19*b* connecting the passage 19*a* to the distribution chamber 30 can be recognized in particular.

The atomisation head 18 also comprises an annular air eddy deflector 33, commonly called a "swirler", installed radially on the outside relative to said plurality of ejection orifices. This deflector comprises vanes 35 on the circumference, between them defining air ejection channels 36 spaced at regular circumferential intervals and directing the air towards the fuel jets.

Distributor 29 consists of two annular parts, one engaged in the other (and brazed together) and between them defining said distribution chamber 30. One of the parts is the body 39 mentioned above. The other part is an annular flange 41 forming a kind of cover; it is engaged at the downstream end of the body. Orifices 31 are bored in this flange 41.

Body 39 and flange 41 comprise cylindrical regions with corresponding diameters, ensuring their centering relative to one another is good. The two parts are assembled by brazing.

Figure 3:
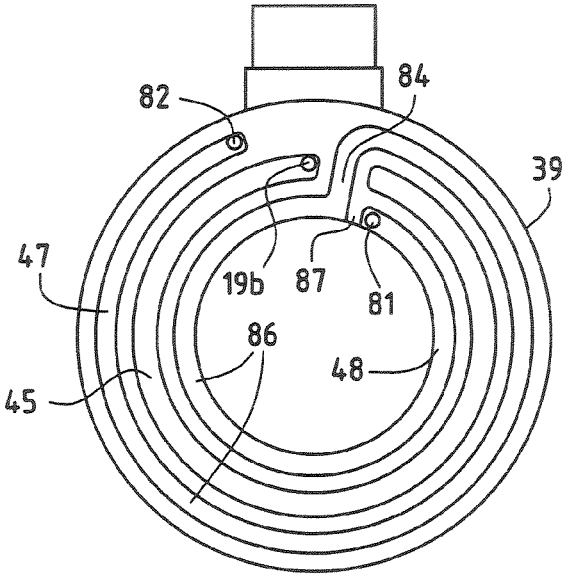
FIG. 3 illustrates the downstream face of the annular body of the fuel injector, obtained by electro-erosion.

As FIG. 3 shows, grooves are engraved on the downstream face of body 39. Groove 45, which is annular overall, defines the essence of the distribution chamber 30, this groove being closed again by flange 41 in order to constitute said chamber 30. The other grooves 47, 48 define a passage section of the primary circuit 17 (they are also closed again by flange 41) and will be described in detail below.

Advantageously, grooves 45, 47, 48 can be obtained by electro-erosion carried out in a single operation on a rough casting of the annular body 39. The shape of the electro-erosion tool corresponds to the configuration of the visible footprints in FIG. 3 and which define these grooves 45, 47, 48.

Figure 2:
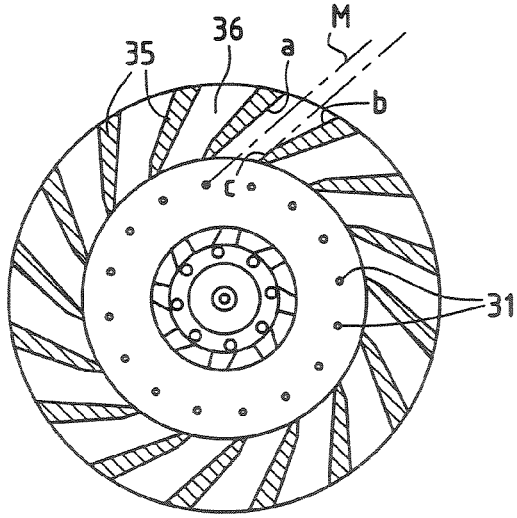
FIG. 2 is a section along line II-II of FIG. 1.

The annular air eddy deflector 33 is made of two annular parts 51, 53 assembled by brazing. It is shown in perspective in FIG. 4. The two parts form a kind of squirrel-cage with vanes 35, the thickness of which decreases towards the interior, as illustrated in FIG. 2. The annular part upstream 51 engages in the annular part downstream 53 comprising vanes 35. Part 51, that is to say the upstream wall of the deflector, comprises an interior cylindrical region 55 with diameter equal to the external diameter of a spherical region 57 of flange 41. This spherical region 57 of the distributor engages in the cylindrical region 55 of the deflector. The annular part downstream 53 extends towards the downstream by a divergent conical element 61, traditionally called a bowl, perforated by two series of orifices 63, 65 distributed at regular intervals along the circumference. The orifices 63 are provided on the conical part of element 61. The smaller orifices 65 are provided on an external radial flange 67. They emerge facing a radial deflector 69 (FIG. 1).

Air coming from the compressor hits the back of the chamber and passes through channels 36 and orifices 63, 65, in particular.

As illustrated, the annular deflector 33 composed of two parts 51, 53 comprises two coaxial internally truncated walls 51*a*, 53*a*, upstream and downstream respectively. The wall 51*a* is defined in part 51. The wall 53*a* is defined in part 53. The conicity of these walls is directed towards the downstream, that is to say their diameter decreases from upstream towards the downstream. The distribution chamber 30 also comprises a truncated wall downstream. It is the wall of the flange 41 in which orifices 31 are provided. The exterior of this wall has a generator parallel to or (as is the case here) merging with the interior face of the upstream wall 51*a* of the annular deflector.

Advantageously, the angle of conicity of these faces ranges between 45° and 80°.

According to another remarkable feature, the axis of each orifice 31 is perpendicular to the generator of surface 51*a* at this point.

By referring to FIG. 2, one defines a median M for each air ejection channel 36, as being a line which is equidistant from the parallel surfaces of at least its radially most internal part. In the example described, in fact the surface a of one of the vanes 35 is even while surface b of the other vane, adjacent, comprises at least a short internal portion c, parallel to surface a. The median M is therefore equidistant from surfaces a and c. The portion located between a and c constitutes the gauge zone of the air ejection channel in question. Surface b could be merged with portion c.

According to a significant feature, for each fuel ejection axis defined by an ejection orifice 31, there is an air ejection channel 36 (between two vanes 35) of which at least the radially most internal part (that is to say the gauge zone) has a median M substantially intersecting this fuel ejection axis.

In the example, the number of fuel ejection orifices is equal to the number of air ejection channels. Alternatively the number of air ejection channels may be a multiple of the number of fuel ejection orifices.

Of course, means of indexing (notches and lugs) are provided in such a way as to obtain the configuration of FIG. 2, for the assembly. Distributor 29 makes up part of the fuel injector 11, deflector 33 being mounted at the back of chamber 13 (the fuel injector 11 and back of chamber 13 being orientated by the casing 23). Distributor 29 slides in deflector 33 around surfaces 55 and 57.

This particular configuration, which positions the air channels of the swirler relative to the fuel ejection orifices, makes it possible to optimise atomisation of this fuel. The homogeneity of the air-fuel mixture improves combustion and reduces pollution.

Further, the incline of the walls 51*a*, 53*a* as a result interrupts to a lesser degree the airflow which crosses the air eddy deflector. Also the axial footprint of the fuel injector is reduced overall.

The atomisation head 18 also comprises a central part 75 (forming an air eddy deflector), mounted axially inside the annular body 39. This part is illustrated in perspective in FIG. 5. It comprises vanes 77 spaced at regular intervals along the circumference. Throats 78 are thus defined between these vanes. The shape of these is such that the throats are inclined relative to axis X. When the central part is engaged in the annular body 39, throats 78 are closed again radially on the outside and define air ejection channels of another air eddy deflector or "swirler" arranged around nozzle 27.

Part 75 comprises a downstream conical part with its conicity directed towards the downstream, which engages in a corresponding conical part defined in body 39, at its upstream end. Vanes 77 are defined in this conical part, which again reduces the axial footprint (according to X) of the atomisation head 18. In addition, upstream, part 75 comprises a cylindrical region 85, which is aligned in a corresponding cylindrical region defined upstream of body 39, for good centering of part 75 in said body 39. Means of indexing ensure positioning in the circumferential direction between part 75 and body 39.

A closed cavity 79 is defined in the centre of part 75. Nozzle 27 is mounted in this cavity. A passage 80 is provided in a vane 77 and emerges in said cavity 79. It constitutes the final part of the primary circuit. This passage 80 communicates with another boring 81 of the body 39, which emerges at one end of groove 48 (FIG. 3). A boring 82, provided in body 39, connects one end of groove 47 to the end of the passage 17*a* which belongs to the primary circuit defined above.

According to an important feature, said primary circuit comprises at least one passage section 86 adjacent said distribution chamber 30, for its cooling. Indeed, this passage section 86 is constituted by channels defined by grooves 47, 48 covered by flange 41. In the examples described, said passage section comprises an external annular section (corresponding to groove 47) radially arranged on the outside relative to said distribution chamber and an internal annular section (corresponding to groove 48) arranged radially on the inside relative to said distribution chamber.

In the embodiment in FIG. 3, the configuration obtained by electro-erosion defines a radial passage 84 crossing the groove 45 and establishing the communication between grooves 47 and 48. A radial wall 87 is also defined in the vicinity of the orifice of boring 81, obliging the fuel to flow over practically 360° in the internal annular section. Consequently, in the example in FIG. 3, the two aforementioned annular sections, constituting said passage section 86 of the primary circuit, are connected in series. The fuel of the primary circuit penetrates into this labyrinth through boring 82, circulates around the distribution chamber 30 radially on the outside, then radially on the inside relative to the latter before rejoining cavity 79 via boring 81 then passage 80.

As the flow of fuel in the primary circuit is permanent, cooling of the distribution chamber 30 is ensured under any circumstances, which avoids the phenomena of coking of the fuel in said distribution chamber, which could occur if the flowrate of the secondary circuit is zero or very weak.

Figure 6:
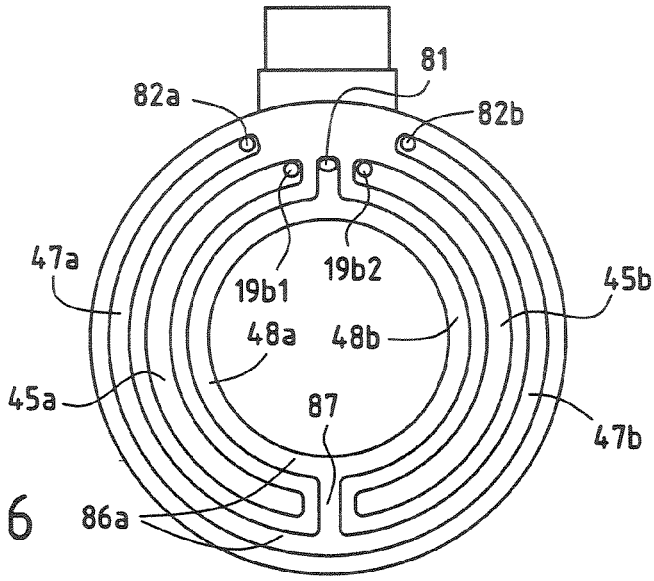
FIG. 6 is a view similar to FIG. 3 illustrating an alternative.

FIG. 6 illustrates an alternative of the configuration of the distribution chamber 30 and of said passage section 86*a* providing its cooling.

The distribution chamber comprises two symmetrical parts (defined by two symmetrical grooves 45*a*, 45*b*) fed separately by two borings 19*b*1, 19*b*2, both connected to passage 19*a*.

The two annular sections, internal and external, defined by the grooves, which surround grooves 45*a*, 45*b*, each comprise two branches adjacent the two symmetrical parts of the distribution chamber (grooves 45*a*, 45*b*) respectively.

The external annular section thus comprises two such symmetrical branches (grooves 47*a*, 47*b*) which separately feed two borings 82*a*, 82*b* communicating with cavity 79 via passages 80*a* and 80*b*. They meet up around a radial passage 87 arranged between the two symmetrical parts of the distribution chamber and rejoin the internal annular section, which also comprises two symmetrical branches (grooves 48*a*, 48*b*) which meet at a point diametrically opposite passage 87, to rejoin boring 81 fed by passage 17*a*.

The symmetrical flow of fuel, which results from this configuration of said passage section 86*a*, adjacent the distribution chamber, ensures particularly homogeneous cooling of the latter.

In the alternative of FIG. 7 where like structural elements are identified by the same reference symbols, the air eddy deflector arranged around nozzle 27 has been modified. This is composed of two axially assembled annular guides 90, 91 defining two counter-rotational "swirlers". In other words, a distinction is made between an internal air eddy deflector 90*a* and an external air eddy deflector 91*a* separated by an annular guide 90 shaped to form a Venturi. Another annular guide 91 extends towards the downstream as far as the bowl to avoid interactions with the "swirler" associated with the distribution chamber 30. This arrangement produces an increase in "shearing" in the airflows, which participate in the atomisation of the fuel coming from the nozzle. The fact that the two swirlers defined around the nozzle are counter-rotational assists concentration of the atomisation of the fuel in the vicinity of axis X. The presence of a Venturi makes it possible to accelerate, then slow down the fuel droplets emitted by the nozzle, which greatly supports atomisation of this fuel. The air coming from the external swirler is introduced into the bowl with a component directed towards axis X. The confluence zone of the two airflows coming from the two swirlers creates flows with a high degree of turbulence, improving atomisation of the fuel. All in all, this architecture ensures good stability and good performance of the combustion chamber at low engine speed.

The invention claimed is:

1. A multimode fuel injector for combustion chambers of the type comprising two coaxial fuel atomisation systems fed respectively by two circuits, a primary circuit with permanent flowrate and a secondary circuit with intermittent flowrate, wherein the injector comprises an atomisation head in which said secondary circuit is connected to an annular distribution chamber perforated with a plurality of fuel ejection orifices distributed at regular intervals along the circumference, said primary circuit comprising at least one passage section adjacent said distribution chamber, for its cooling, wherein said passage section comprises an external annular section arranged radially on the outside relative to said distribution chamber and an internal annular section arranged radially on the inside relative to said distribution chamber.

2. A fuel injector according to claim 1, wherein the two annular sections are connected in series.

3. A fuel injector according to claim 1, wherein said distribution chamber comprises two symmetrical parts fed separately and the two internal and external annular sections each comprise two branches adjacent said two symmetrical parts respectively.

4. A fuel injector according to claim 3, wherein the two branches of said internal annular section and the two branches of said external annular section communicate through a radial passage arranged between the two symmetrical parts of the distribution chamber.

5. A fuel injector according to claim 1, wherein said atomisation head comprises an annular body in which grooves are engraved, defining said distribution chamber and said passage section of said primary circuit, and an annular flange covering said grooves, said fuel ejection orifices being provided in said flange.

6. A fuel injector according to claim 5, wherein said grooves are obtained by electro-erosion carried out in a single operation on a rough casting of said annular body.

7. A fuel injector according to claim 5, wherein said annular body is mounted at the end of an injector arm in which are arranged two coaxial passages, belonging to said primary circuit and said secondary circuit respectively.

8. A fuel injector according to claim 1, wherein said atomisation head comprises an axial fuel ejection nozzle, connected to be fed by said primary circuit.

9. A fuel injector according to claim 5, wherein said atomisation head comprises an axial fuel ejection nozzle, connected to be fed by said primary circuit and said nozzle being installed in a central part mounted inside said annular body and in which are defined vanes of an air eddy deflector.

10. A combustion chamber, comprising a plurality of multimode fuel injectors according to claim 1.

11. A jet engine, comprising a combustion chamber according to claim 10.

* * * * *